United States Patent [19]

Moench

[11] 4,226,552

[45] Oct. 7, 1980

[54] ASPHALTIC PAVEMENT TREATING APPARATUS AND METHOD

[76] Inventor: Frank F. Moench, P.O. Box 6484, Station B, Albuquerque, N. Mex. 87107

[21] Appl. No.: 906,450

[22] Filed: May 17, 1978

Related U.S. Application Data

[63] Continuation of Ser. No. 747,295, Dec. 3, 1976, abandoned.

[51] Int. Cl.[2] ..... E01C 23/12

[52] U.S. Cl. ..... 404/92; 404/77; 404/83; 404/75; 404/91; 366/1; 366/54

[58] Field of Search ..... 404/92, 91, 75, 72, 404/95, 77, 110; 366/1, 54

[56] References Cited

U.S. PATENT DOCUMENTS

| | | | |
|---|---|---|---|
| 1,195,273 | 8/1916 | Sheerer | 404/77 X |
| 1,310,546 | 7/1919 | Ryan | 404/79 X |
| 2,053,709 | 9/1936 | Flynn | 404/75 |
| 2,169,406 | 8/1939 | Cost | 404/92 |
| 2,254,463 | 9/1941 | Wells | 404/95 |
| 2,257,637 | 9/1941 | Moore | 404/90 |
| 2,439,367 | 4/1948 | Middlestadt | 404/79 X |
| 3,361,042 | 1/1968 | Cutler | 404/77 |
| 3,820,914 | 6/1974 | Zimmerman | 404/110 |
| 3,843,274 | 10/1974 | Gutman | 404/91 |
| 3,970,404 | 7/1976 | Benedetti | 404/77 |
| 3,997,276 | 12/1976 | Jackson | 404/77 |
| 4,000,000 | 12/1976 | Mendenhall | 108/280 |
| 4,011,023 | 3/1977 | Cutler | 404/91 |
| 4,124,325 | 11/1978 | Cutler | 404/75 |

*Primary Examiner*—Nile C. Byers, Jr.
*Attorney, Agent, or Firm*—Ancel W. Lewis, Jr.

[57] ABSTRACT

A series of treatments are performed on old asphaltic pavement to make it suitable for being satisfactorily applied as a new mat. The old asphaltic pavement is heated and scarified to form a loose aggregate-asphaltic mixture while remaining on the ground surface. The mixture is removed from the ground surface and heated in an elongated rotary housing having heated conductors without direct flame contact with the mixture, and the mixture is then thoroughly mixed with a conditioner for old asphaltic pavement, and finally is reapplied to the ground surface as a new mat. The treatments are carried out by independently operable, portable apparatus during the movement of all of the apparatus in a coordinated train that moves over the ground surface.

29 Claims, 15 Drawing Figures

ASPHALTIC PAVEMENT TREATING APPARATUS AND METHOD

This is a continuation of application Ser. No. 747,295, filed Dec. 3, 1976 and now abandoned.

FIELD OF THE INVENTION

This invention relates generally to the treatment of asphaltic pavement and more particularly to a novel apparatus and method for treating asphaltic pavement that is especially suited for providing a new layer of asphaltic pavement using recycled or reclaimed asphaltic pavement.

BACKGROUND OF THE INVENTION

The forming and applying of asphaltic pavement and particularly as it relates to highway and roadway surfaces, is an industry of considerable magnitude and importance. Asphaltic pavement in the course of continuous usage becomes oxidized, dry and brittle and frequently develops rolls or undulating surfaces and also develops holes which require repair or a complete replacement of segments of the pavement. The most satisfactory asphaltic pavement highway is of course a new mat because of the smoothness, uniformity and continuity thereof. Some of the prior known repair or reconditioning practices involve the softening of the upper layer and reworking thereof, in situ, followed by a rolling of the material into a substantially smoother condition. This practice is discussed in U.S. Pat. Nos. 1,952,452 and 3,005,280. Another approach has been to remove substantially all of the asphaltic pavement from the ground surface or substrate and transport it to a remote reconditioning mill, recondition same, and return it to the roadworking machinery, as is described in U.S. Pat. No. 3,845,941, and this practice of course requires considerable expense and time in the transportation of the old asphaltic material to and from the reconditioning mill.

Some attempt has been made to recondition the old, oxidized asphaltic pavement by completely removing at least a layer from the ground surface, adding a reconditioner thereto, and then reapplying this material in a new mat during continuous vehicular movement, as is described in U.S. Pat. No. 3,843,941. Some of the difficulties encountered in this approach in an inability to penetrate, remove and break up enough of the old asphaltic pavement material with existing equipment and another is to restore the once used material to a satisfactory condition in which it may be readily applied during steady movement over a ground surface.

Accordingly, it is an object of the present invention to provide a novel apparatus and method for treating asphaltic pavement material in which a considerable amount of old asphaltic pavement is reclaimed or reused to form a new mat, thereby providing a substantial savings in cost and a substantial conservation of resources.

Another object of the present invention is to provide novel apparatus and method for treating asphaltic pavement that is carried out by portable machinery during a steady movement over a ground surface.

Still another object of the present invention is to provide a novel apparatus and method for treating old asphaltic pavement which includes the capability of removing asphaltic pavement down to substantial depths.

A further object of this invention is to provide reconditioning apparatus and method of treating old, oxidized asphaltic pavement including the complete removal of asphaltic pavement from the ground surface and the heating of the removed, loose, aggregate-asphaltic material to a temperature suitable for being reapplied as a new mat without requiring a direct flame on the asphalt.

SUMMARY OF THE INVENTION

A train of independent apparatus performs a series of operations on old asphaltic pavement including the reconditioning thereof and applies the reconditioned pavement material to form a new mat of asphaltic pavement during steady, coordinated movement of the apparatus over a ground surface. There is provided surface treating apparatus for heating and breaking up old asphaltic pavement into a loose, aggregate-asphalt mixture that is of approximately the original aggregate size range while the pavement and resulting mixture are supported on a ground surface. There is conditioning apparatus arranged for picking up the mixture from the ground surface and heating the mixture to a selected high temperature followed by the thorough mixing of a preselected amount of conditioner for oxidized asphalt with the heated, aggregate-asphalt mixture to form a hot, reconditioned, loose, aggregate-asphalt mixture of a temperature, content and consistency suitable for being rolled into a new mat of asphaltic pavement. There are further provided apparatus for spreading and leveling the reconditioned mixture on a trailing ground surface as well as apparatus for compacting the leveled mixture into a new mat of asphaltic pavement.

Other objects, advantages and capabilities of the present invention will become more apparent as the description proceeds taken in conjunction with the accompanying drawings, in which like parts have similar reference numerals and in which.

Figures 1, 2, 3, 4, 5, 6, 7, 8, 9:
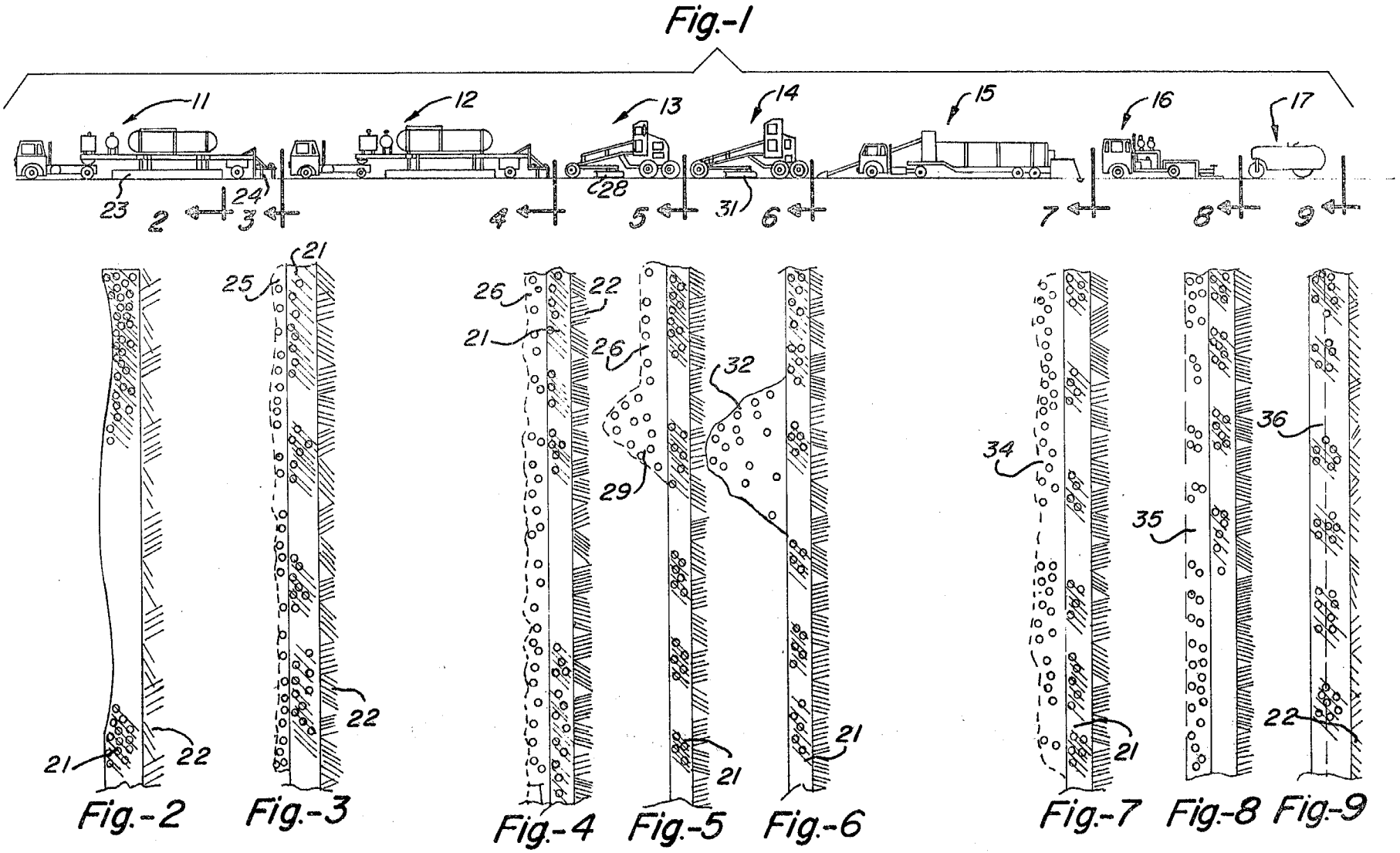
FIG. 1 is a side elevation view of a train of apparatus in accordance with the present invention.
FIG. 2 is a sectional view taken along lines 2—2 of FIG. 1.
FIG. 3 is a sectional view taken along lines 3—3 of FIG. 1.
FIG. 4 is a sectional view taken along lines 4—4 of FIG. 1.
FIG. 5 is a sectional view taken along lines 5—5 of FIG. 1.
FIG. 6 is a sectional view taken along lines 6—6 of FIG. 1.
FIG. 7 is a sectional view taken along lines 7—7 of FIG. 1.
FIG. 8 is a sectional view taken along lines 8—8 of FIG. 1.
FIG. 9 is a sectional view taken along lines 9—9 of FIG. 1.
Figure 12:
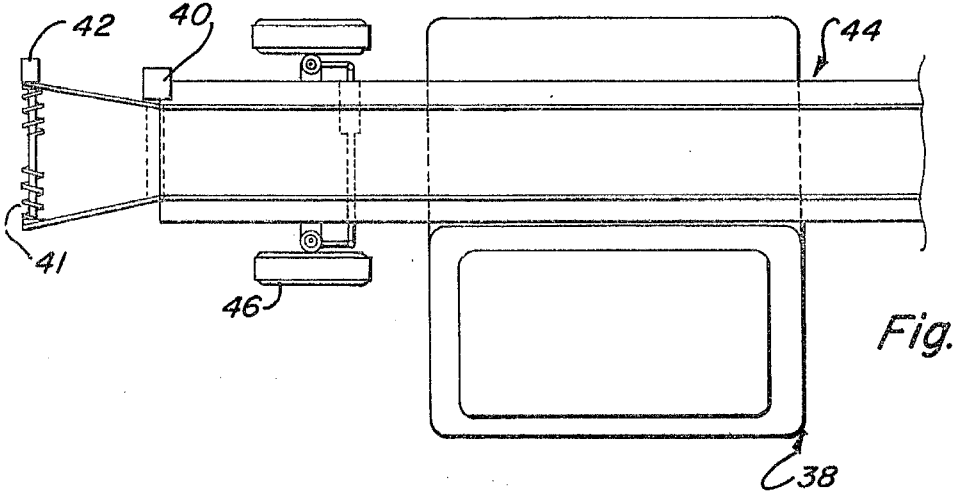
FIG. 12 is a top plan view of a forward portion of the reconditioning apparatus shown in FIG. 10.

Referring now to FIG. 1, there is shown a train of independent, portable apparatus that performs a series of successive operations on old, hard, oxidized asphaltic pavement to form a loose, heated asphalt-aggrate, reconditioned mixture and returns the reconditioned mixture to the surface where it is formed into a new asphaltic pavement mat as the train of apparatus moves steadily along the ground surface in a coordinated movement. Beginning at the forward or leading end and progressing to the rear end, the apparatus shown in FIG. 1, in general, comprises a surface-treating apparatus 11, a surface-treating apparatus 12, a road grader 13, a road grader 14, reconditioning apparatus 15, leveling apparatus 16, and compacting apparatus 17.

The series of operations or treatments performed on the old asphaltic pavement by the above-mentioned apparatus and its conversion into a new mat are illustrated in FIGS. 2–9. Referring now to FIG. 2, there is represented a top layer of old, hard, oxidized asphaltic pavement 21 on a ground surface base or subgrade represented at 22, as would be present in a typical asphalt highway or roadway or the like. Asphaltic pavement is comprised of a mixture of aggregate of a selected size range and a bituminous or asphalt binder. The pavement 21 represents a typical highway pavement which after usage has an irregular top surface. Typically there are lower spots or recessed areas where vehicle tires regularly contact the top surface of the pavement. Moreover, hard asphaltic pavement after it has been laid down as a hard mat becomes brittle and loses portions of its composition through oxidation. In addition, old asphaltic pavement frequently develops holes, cracks and the like.

The surface treating apparatus 11 and 12 are described in detail in my U.S. Pat. No. 3,989,401. Generally stated, this apparatus has a hood 23 lined with a refractory having an open bottom that is supported in spaced relation to the top of the pavement surface and has associated gas burners to heat the inside of the hood which in turn radiates substantial heat down on the pavement to penetrate the top surface of the pavement to a substantial depth. The hood 23 is followed by a scarifying assembly 24 comprised of rows of scarifying elements that penetrate into and break up the heated pavement. This apparatus is capable of breaking up the pavement into a relatively loose, aggregate-asphalt mixture represented at 25 that is shown as lying on a remaining lower layer of the hard asphaltic pavement. This mixture has a consistency of approximately the original aggregate size such as a three-fourths inch size. This scarifying operation also serves to spread out the relatively loose mixture and would tend to level and fill unusually low spots or holes in the old pavement as the scarifying assembly passes over and through the mixture.

The next succeeding surface treating apparatus 12 is constructed and operates in the same manner as surface treating apparatus 11 by heating the pavement to yet another substantial depth and breaking up the pavement 21 down to a further depth and converting this pavement into a relatively loose aggregate and asphalt mixture shown as a layer 26, again having a consistency of approximately the original aggregate size. The depth of penetration of the apparatus 11 and 12 will of course be adjusted according to the specific pavement being reconditoned. In some cases this apparatus may penetrate and remove essentially all of the asphaltic pavement down to the ground surface or substrate of aggregate or the like or may leave a lower layer of pavement as shown. In a typical roadworking operation, apparatus 11 heats and breaks up to a depth of about one-half inch and apparatus 12 to a depth of about one-half inch, for a total penetration of old asphaltic pavement from the original top surface to a depth of about one inch. Accordingly, the operations on the old asphaltic pavement by apparatus 11 and 12 facilitate the removal and reuse of substantial portions of the old asphaltic pavement.

The road grader 13 is of a conventional, commercially available construction and has a scraping blade 28 arranged at an angle to the direction of movement thereof and moves the loose, asphalt-aggregate mixture 26 from approximately one-half of the lateral extent of the pavement surface to a pile or windrow 29 at approximately the center of the road. Similarly, road grader 14 has a scraping blade 31 arranged on an incline to the direction of movement thereof and is on an incline opposite to that of blade 28 so that together they would form a substantially V-shaped configuration, although one trails the other in the operation thereof. Blade 31 moves the mixture 24 on the other approximately one-half of the lateral extent of the pavement toward the center to form yet a larger windrow or pile, as represented at 32 in FIG. 6.

The reconditioning apparatus 15 is arranged to pick up the aggregate-asphalt mixture in the pile 31 as it is moved forwardly along the roadway and then heats the raised mixture. At this stage a conditioner for the old asphaltic paving may be added to the mixture as required, depending on the composition of the old asphaltic pavement being removed. The resulting reconditioned mixture is returned to the trailing ground surface in a loose, partially distributed pile, as represented at 34 in FIG. 7. The apparatus shown affords the addition of new aggregate which may be added to the pile 31 or otherwise delivered to the input side of apparatus 15 and also affords the addition of more asphaltic oil into the input side of apparatus 15 if required.

The leveling apparatus 16 then screeds or levels off the reconditioned mixture to a layer in a smoother, better distributed form that is more widely distributed across the roadway, as represented at 35, and finally the compacting apparatus 17 rolls the laid down, reconditioned mixture 35 into a smooth, hard, new mat or surface as represented at 36 using conventional roadworking techniques.

The reconditioning apparatus 15 shown in more detail in FIGS. 10–15 includes a trailer 36 having a frame supported on rear wheels 37, the trailer being drawn by a truck 38. Truck 38 has front wheels 39 and rear wheels 41. A pickup conveyor assembly is supported on one side of the truck 38 and includes a front-mounted auger 41 driven by an electric motor 42. The auger 41 is mounted on the front end of a scoop box 43 at the leading end of a motor-driven conveyor 44 including a forward section 44*a* that extends up and rearwardly from the scoop box 43 and a rear section 44*b* that extends horizontally and discharges the mixture. A turnable wheeled chassis 46 supports the lead end of the conveyor just rearwardly of box 43 to provide for the turning of the scoop box 43 with the turning of the truck 38.

Figure 10:
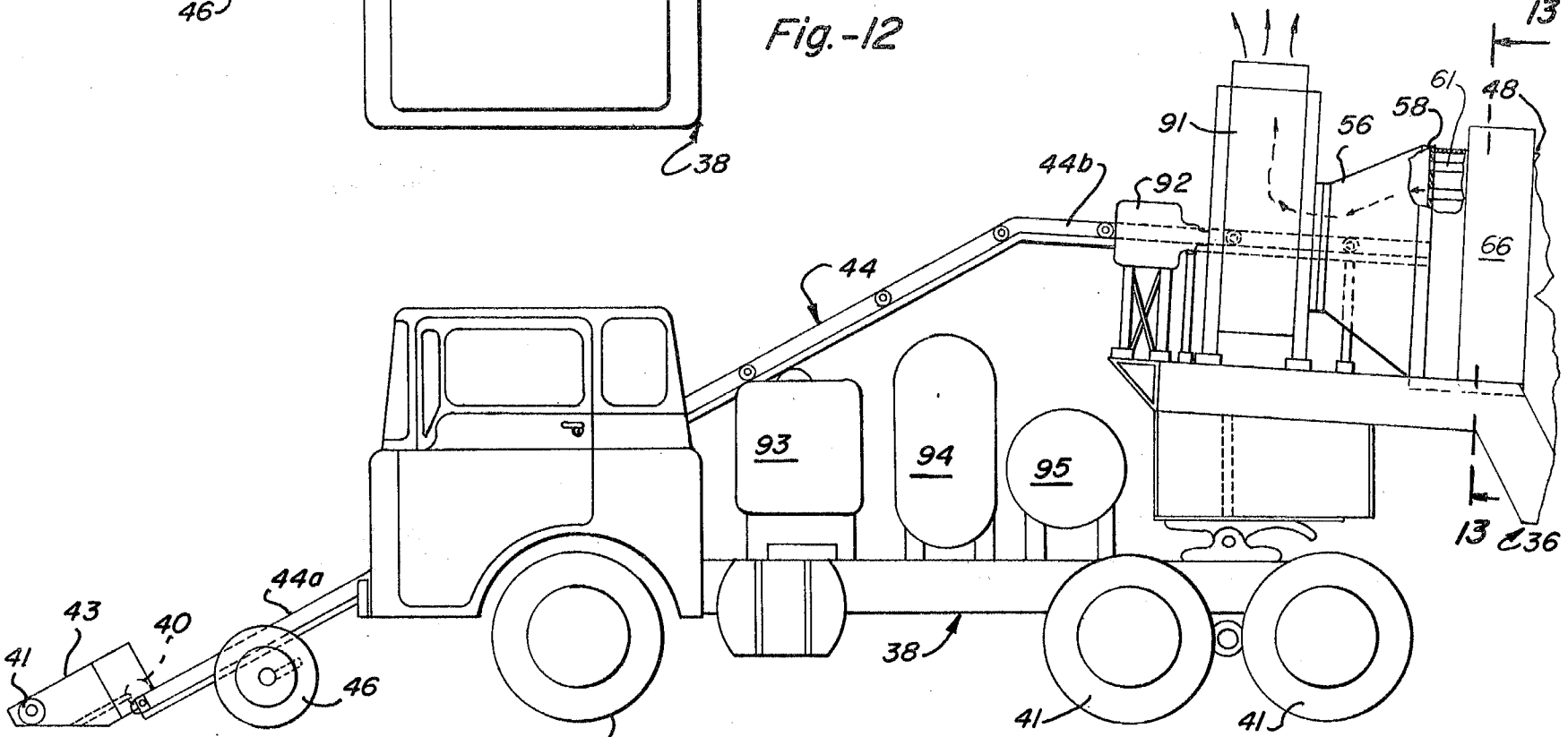
FIG. 10 is a side elevation view of the forward portion of the reconditioning apparatus shown in FIG. 1.
Figure 13:
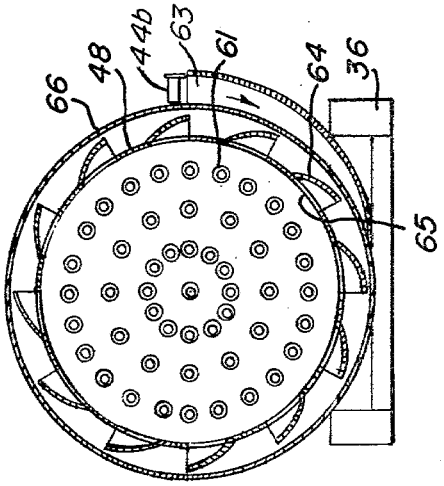
FIG. 13 is a sectional view taken along lines 13—13 of FIG. 10.
Figure 11:
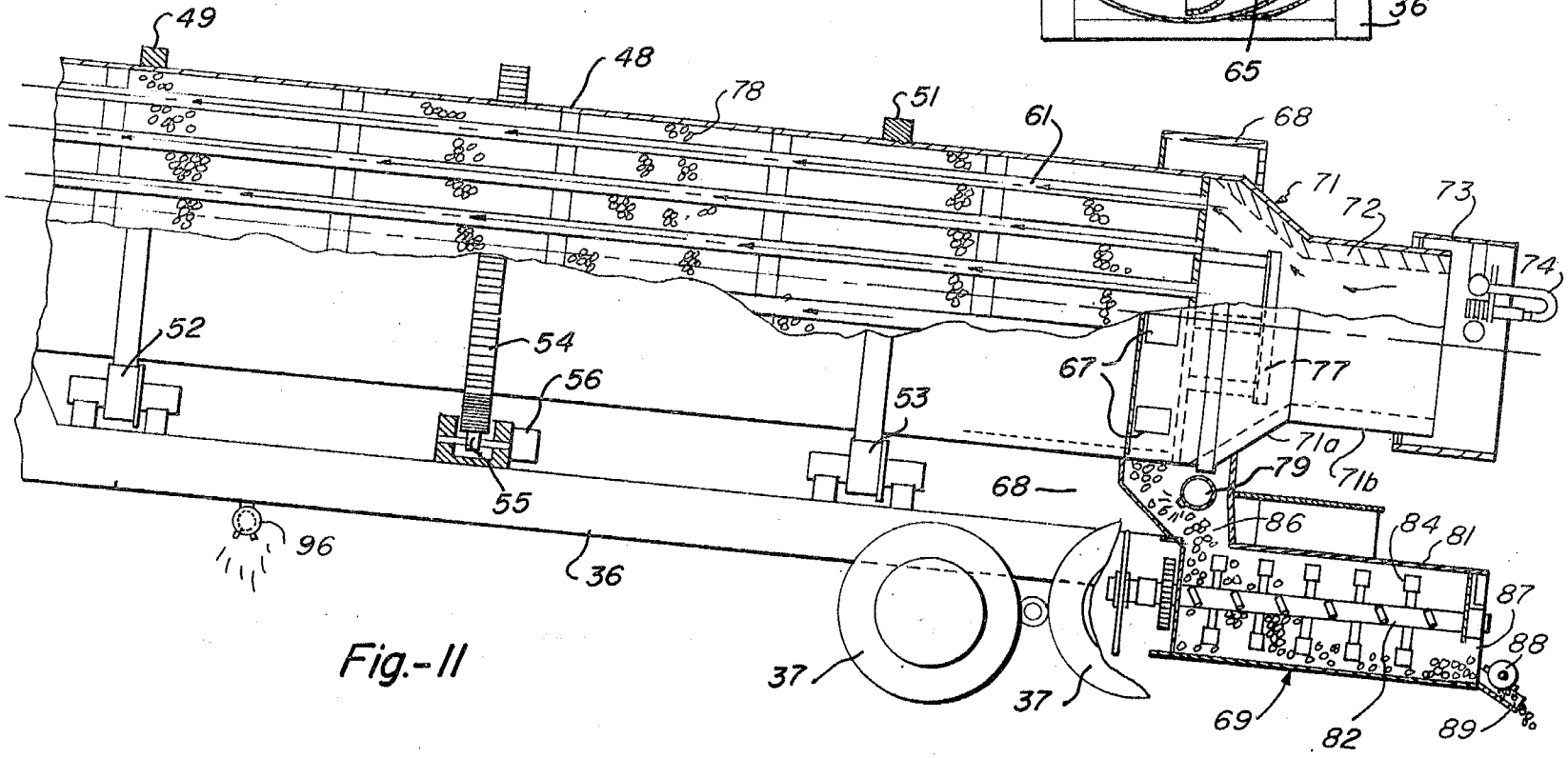
FIG. 11 is a side elevation view of the rear portion of the reconditioning apparatus shown in FIG. 1.
Figure 15:
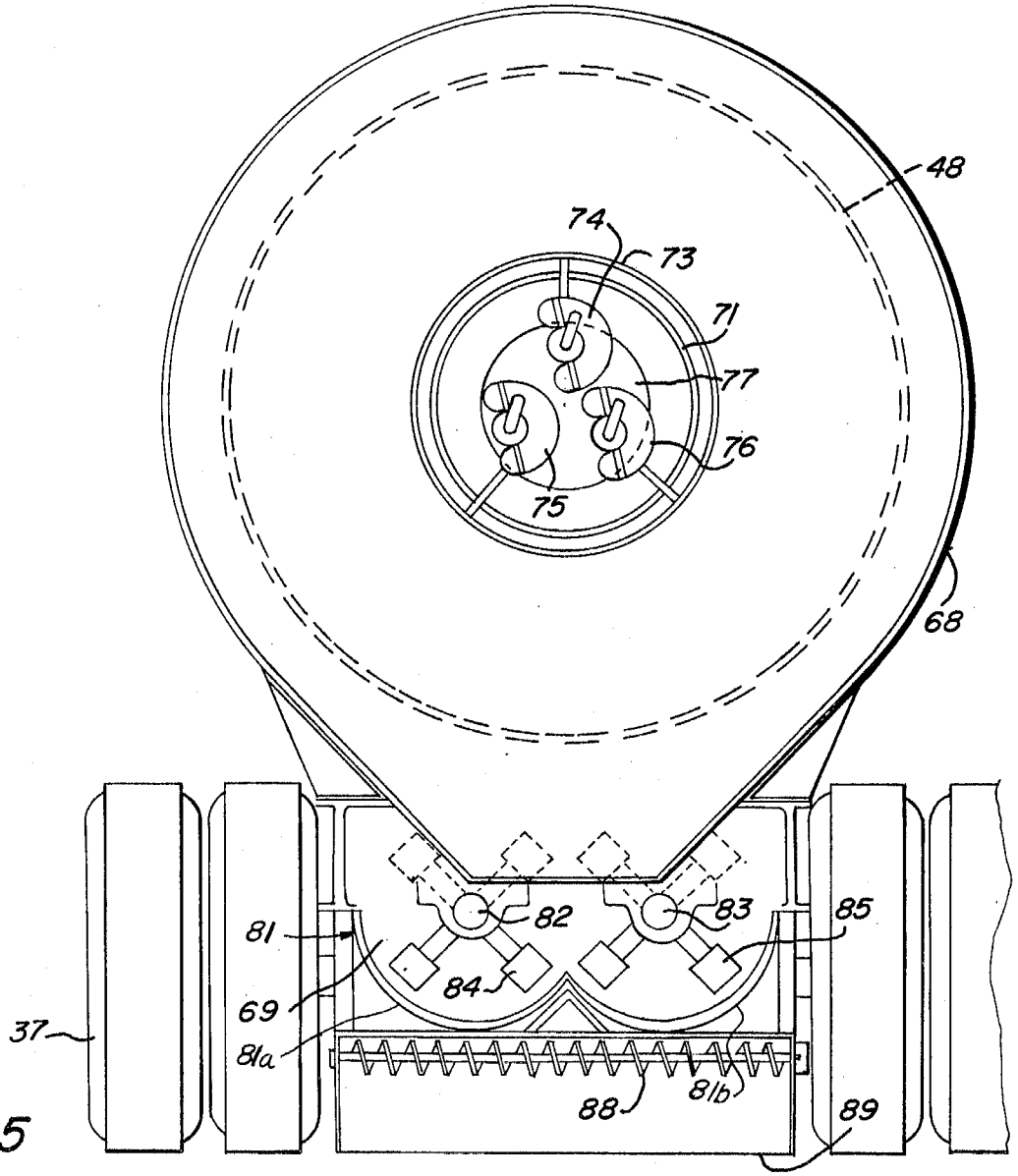
FIG. 15 is a rear end elevation view of the reconditioning apparatus of FIG. 11.
Figure 14:
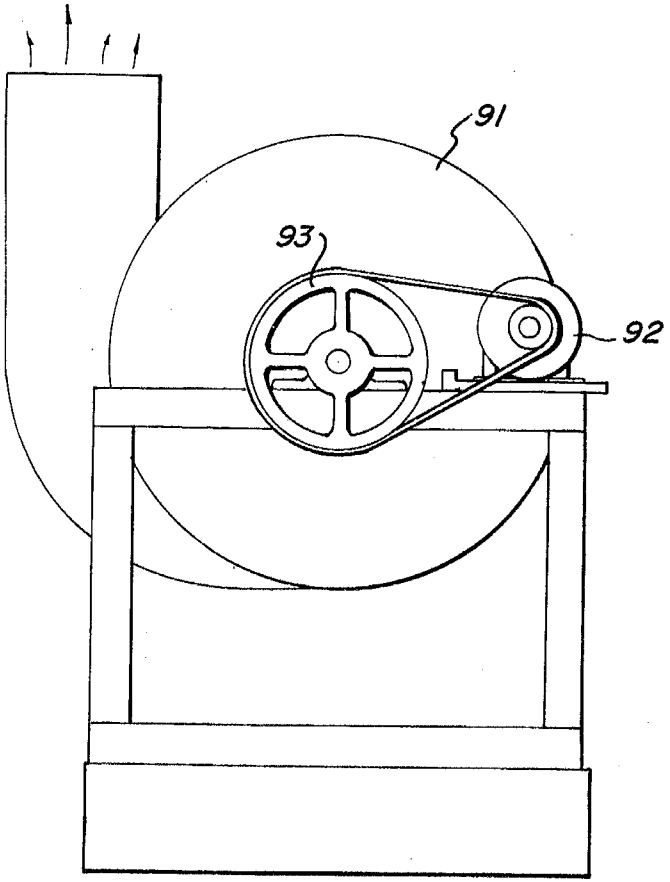
FIG. 14 is a front end elevation view of the reconditioning apparatus shown in FIG. 10.

The heating portion of the apparatus 15 is carried on the frame of trailer 36 and as shown comprises an elongated, cylindrical drum or housing 48 having an external front bearing band 49 and an external rear bearing band 51 which rests on sets of bearings 52 and 53, respectively. Each of the sets of bearings 52 and 53 mount on the frame of the trailer and are two free-rolling rollers or bearings on opposite sides of a vertical line through the center of the drum so that the housing is supported for rotation about a substantially horizontal axis with a slightly downward incline from front to rear so that gravity assists in passing the asphalt-aggregate mixture through the drum from the inlet to the outlet thereof. As shown in FIGS. 9 and 10, this angle for the drum 48 is about 9 degrees to the horizontal. The housing 48 is rotated about the longitudinal axis by means of a gear 54 affixed to the periphery of the housing that meshes with a gear 55 driven by an electric drive 56 supported on the frame of the trailer 36.

The housing 48 is essentially cylindrical, having a uniform cross section throughout its length, and has an imperforate end cap 58 covering the front end except for the pipe openings described hereinafter and an imperforate end cap 59 covering the rear end except for the pipe openings described hereinafter. These end caps 58 and 59 support a plurality of hollow, heat-conductive pipes 61 that extend longitudinally of the inside of the housing with the inside of the housing closed off by the end caps and forming a heating chamber for the asphalt-aggregate mixture. The pipes 61 are preferably made of metal and are in open communication with the outside of the housing beyond the end caps for the passage of heated air therethrough. There is sufficient spacing between the pipes 61 to form the heating chamber and permit the loose asphaltic material mixture to pass therebetween as the housing is rotated about its longitudinal axis. The details of the housing 48 and pipes 61 may be constructed in accordance with U.S. Pat. No. 3,845,941.

For the feeding of material into the feed end of the housing 48 there is provided a cover or shroud 66 that is stationary relative to the rotating housing 48 constructed with a feed trough 63 with a top inlet or feed opening. The discharge end of the conveyor section **44*b* is arranged above trough 63 to feed the mixture into the top opening of the trough 63. A series of scoops 64 are mounted at spaced intervals about the circumference of the housing 48 that move through the trough and cause the mixture to be forced through an inlet opening 65 associated with each scoop. The inlet or feed openings 65 are located at circumferentially spaced intervals in the periphery of the housing at the forward or lead end just downstream of the end cap or closure wall 58. In this way as the housing 48 is rotated the scoops 64 direct the mixture into the inside of the housing and the mixture is tumbled between the heated pipes 61 and moves from the inlets 65 to the outlets 67** or from front to rear along the slight downward incline.

At the discharge end of the housing 48 the series of discharge openings 67 are arranged at circumferentially spaced intervals in the periphery of the housing. A discharge casing or shroud 68 surrounds the rear end of the housing and encompasses these discharge openings 67 and this shroud has downwardly converging wall portions that form a chute to direct the discharged mixture into the feed end of a pug mill 69 also mounted on the rear end of the trailer 36 and discussed more fully hereinafter.

A heating assembly for heating the air that flows through the pipes 61 in the housing is mounted on and forms a rear coaxial extension of the rear end of the housing 48. This heating assembly includes a housing 71 affixed at its front end to the rear end of the housing 48 and has a tapered portion **71*a* and a cylindrical narrowed rear end portion 71*b* and is open at the rear end. Housing 71 is lined with a refractory 72 for heat insulation purposes. A circular support section 73 is caxially aligned with section 71 and supports three gas burners 74, 75 and 76 arranged to direct a heating flame forwardly toward the pipes and against a deflector 77. The construction and operation of the burners is described in more detail in my U.S. Pat. No. 3,840,321. Deflector 77 is positioned between the flame from the burners and the inlet openings in the heating pipes 61. Heated air produced in the heating chamber by the burners is drawn through the pipes 61 from rear to front, as indicated by arrows, and through a funnel-shaped housing 56 at the front end by a blower 91 driven by an electric motor 92. The heat is conducted through the conductive pipes 61 and heats the mixture in the housing designated by numeral 78** up to temperatures in the range of 280° F. to 320° F. and preferably about 300° F.

A spray assembly 79 is shown as mounted on the trailer 36 at the rear end thereof rearwardly of wheels 37 to spray a conditioner or a conditioner and asphalt oil mixture into the asphalt-aggregate mixture as it is discharged from the housing 48 and prior to its being mixed in the pug mill 69. The pug mill 69 may be of a conventional commercially available construction and as shown is of a twin blade design which includes a housing 81 constructed with two arcuate lower sections **81*a* and 81*b* arranged side-by-side in which there are disposed two spaced parallel shafts 82 and 83, respectively. Shafts 82 and 83 each have a plurality of axially spaced and radially extending mixing blades 84 and 85, respectively, that serve to mix the hot, asphalt-aggregate mixture with the conditioner or conditioner and asphalt oil mixture as required. Material entering the forward inlet 86 is passed through the pug mill 69 through a discharge outlet 87. In the pug mill 69 the discharge from the housing 48 is thoroughly and intimately mixed with the discharge from spray assembly 79. In the event aggregate has been added to the mixture as above discussed, this will also be further mixed for greater homogeny. A rotary auger-type spreading device 88, preferably also driven by an electric motor, is mounted at the discharge outlet of the pug mill 69 to spread the discharged mixture across a deflector plate 89** which in turn drops the material down over the trailing surface.

The truck 38 is shown to carry an electric generator 93 for providing electric power to the electric motors used as drives for the rotary devices above described, a tank 94 containing a reconditioning agent for old asphaltic pavement or a mixture of reconditioning agent and asphalt oil in a measured proportion by weight, and a tank 95 containing propane for the gas burners 74, 75 and 76.

The reconditioning agent or composition added to the heated aggregate-asphalt mixture must be capable of replacing ingredients that are lost during oxidation, including resins, and also must be capable of chemically softening the old brittle pavement to reduce the viscosity to the range of virgin asphalt. These resins must be capable of resolubilizing the asphaltenes in the asphalt. A conditioner having a major content of aromatic oils by weight and exhibiting a viscosity in the range of 200 cs at 140° F., a flash point of about 400° F., and a solubility parameter of about 8.5 has been found to be particularly effective in replacing the resins and softening old asphaltic pavement.

A spray nozzle 96 supplied by a suitable supply tank in the trailer is mounted ahead of the rear wheels 37 of the trailer for applying a suitable tack coating to the scarified surface to enhance the application of the new mixture to the old scarified surface. This tacking is frequently used when the old asphaltic pavement has become badly oxidized.

In a full sequence of operation for the above described apparatus the old asphaltic pavement is heated and scarified by apparatus 11, heated and scarified by apparatus 12, and the trailing graders 13 and 14 pile the loose aggregate mixture into a center pile on the ground surface. Optionally, additional aggregate may be added to the pile, if required. The pile is then elevated by the pickup and conveyor assembly and fed into the inlet of the heating housing 48 where it is heated by the hot pipes and tumbled toward the rear discharge end. The temperature of the asphalt-aggregate mixture in the housing 48 is raised to about 300° F. The mixture discharging from housing 48 is sprayed with the conditioner or a mixture of conditioner and asphalt oil and then the combination of ingredients is intimately mixed in the pug mill and spread out over the road surface, leveled and spread by apparatus 16, and then compacted with the roller apparatus 17.

Although the present invention has been described with a certain degree of particularity, it is understood that the present disclosure has been made by way of example and that changes in details of structure may be made without departing from the spirit thereof.

What is claimed is:

1. In apparatus for reconditioning asphaltic pavement for road surfacing and the like, a combination comprising:

a frame supported on wheels for vehicular movement over a ground surface;

an elongated, generally cylindrical housing on said frame mounted for rotation about a longitudinal axis forming an inner chamber elevated above the ground surface having a material inlet at one end and a material outlet at the opposite end through which a loose asphalt-aggregate mixture delivered to said material inlet passes and is discharged through said material outlet, said chamber having a gas inlet at one end and a gas outlet opposite the gas inlet to pass gas through said chamber;

drive means operatively associated with said housing for rotating said housing about its longitudinal axis;

means for picking up said mixture from the ground surface while moving relative to the ground surface and delivering said mixture to said material inlet;

heating means operatively associated with said housing for heating gases passed through said gas inlet in heat exchange relation to said mixture and out said gas outlet to heat said mixture as said mixture is tumbled in said housing for uniformly, simultaneously heating and mixing said mixture;

means movable with said heating means and operatively associated with said housing for adding a conditioner replacing at least some of the ingredients lost by oxidation of the asphaltic pavement to said heated mixture; and mixing apparatus on said frame for thoroughly and intimately mixing the conditioner and picked-up mixture independently of the ground surface while confined in a mixing chamber supported above the ground surface, said chamber having a bottom wall over which the conditioned mixture is moved above the ground surface between an inlet and an outlet and further having paddle blades disposed in an axially spaced and radially extending arrangement above the bottom wall between the inlet and outlet, to form a reconditioned mixture of a composition and consistency suitable for being rolled into a new mat of asphaltic pavement while moving relative to the ground surface, said converting, picking up and mixing being coordinated in movement with one another relative to the ground surface.

2. In apparatus as set forth in claim 1 wherein said housing has a plurality of heated heat-conductive pipes open at both ends and extending inside the housing through which said heated gases pass to conduct heat to said mixture.

3. In apparatus as set forth in claim 1 wherein said pickup means includes a front scoop box and a power-driven conveyor extending from the scoop box arranged to feed into a feed trough associated with said material inlet of said housing.

4. In apparatus as set forth in claim 1 wherein said heating means includes a heating chamber coaxially aligned with one end of said housing with gas-fired heaters mounted to heat the gases in said heating chamber, and blower means at the end of the housing opposite said heating chamber arranged to draw heated gases through said inner chamber to heat said mixture passed through said housing.

5. In apparatus as set forth in claim 1 wherein said means for introducing a conditioner for old asphalt into the mixture is a spray that sprays the heated mixture as it discharges from said housing and prior to entering said mixing apparatus.

6. In apparatus as set forth in claim 1 wherein said mixing apparatus is in the form of a pug mill having a housing and at least one shaft with radially extending and axially spaced blades to intermix the mixture passing therethrough.

7. In apparatus as set forth in claim 6 wherein said mixing apparatus has a spreader at the outlet of the pug mill to spread the mixture out across a trailing ground surface.

8. In apparatus as set forth in claim 1 wherein said housing is inclined at a slight angle to the horizontal so that the material outlet is below the material inlet for gravity flow of said mixture through said housing.

9. In apparatus for treating asphaltic pavement for road surfacing and the like, a combination comprising:

first means for converting old asphaltic pavement into a loose, heated aggregate-asphalt mixture that has the consistency of approximately the original aggregate size range while moving along the ground surface and while the mixture remains on the ground surface;

means trailing said first means for picking up said mixture from the ground surface;

means movable with said picking-up means for for adding a preselected amount of conditioner for old asphaltic pavement to said picked-up mixture, said conditioner replacing at least some of the ingredients lost during oxidation of the old asphaltic pavement and softening said pavement; and means movable with said adding means for thoroughly and intimately mixing the conditioner and picked-up mixture independently of the ground surface while confined in a mixing chamber supported above the ground surface, said chamber having a bottom wall over which the conditioned mixture is moved above the ground surface between an inlet and an outlet and further having paddle blades disposed in an axially spaced and radially extending arrangement above the bottom wall between the inlet and outlet, to form a reconditioned mixture of a composition and consistency suitable for being rolled into a new mat of asphaltic pavement while moving relative to the ground surface, said converting, picking up and mixing being coordinated in movement with one another another relative to the ground surface.

10. In apparatus as set forth in claim 9 including screed apparatus following said means for mixing for leveling the mixture across a trailing ground surface.

11. In apparatus as set forth in claim 10 including roller apparatus following said screed apparatus for compacting the mixture into a new mat of asphaltic pavement.

12. In apparatus as set forth in claim 9 wherein said means for converting includes a hood positioned over the old asphaltic pavement having a heated refractory body that radiates heat into the old pavement to heat the old pavement to a selected depth, followed by a scarifying assembly inclusive of a plurality of laterally spaced scarifying elements that penetrate into the old asphaltic pavement to break up said pavement, said hood and scarifying assembly being moved n a common vehicle.

13. In a method of treating asphaltic pavement for road surfacing and the like, the steps comprising:

converting old asphaltic pavement on a ground surface into a loose, aggregate-asphalt mixture by heating said pavement to a selected temperature and depth and reducing the size thereof to approximately the original aggregate size range while said pavement and mixture remains on the ground surface and while moving relative to the ground surface;

picking up said mixture from the ground surface and simultaneously mixing by a tumbling action and heating said picked-up mixture to a temperature suitable for adding a conditioner and for being rolled into a new mat of asphaltic pavement while moving relative to the ground surface;

adding a preselected amount of conditioner for old asphaltic pavement to said picked-up mixture, said conditioner replacing at least some of the ingredients lost during oxidation of the old asphaltic pavement and softening said pavement;

thoroughly and intimately mixing the conditioner and picked-up mixture independently of the ground surface while confined in a mixing chamber supported above the ground surface, said chamber having a bottom wall over which the conditioned mixture is moved above the ground surface between an inlet and an outlet and further having paddle blades disposed in an axially spaced and radially extending arrangement above the bottom wall between the inlet and outlet, to form a reconditioned mixture of a composition and consistency suitable for being rolled into a new mat of asphaltic pavement while moving relative to the ground surface, said converting, picking up, heating and mixing being coordinated in movement with one another relative to the ground surface.

14. In a method as set forth in claim 13 wherein said converting of old asphalt pavement includes two successive stages of heating and reducing the size.

15. In a method as set forth in claim 14 wherein said heating of the pavement includes heat energy that is radiated from a heated refractory both moved over the old asphaltic pavement.

16. In a method as set forth in claim 13 wherein said reducing of size of the heated, old asphaltic pavement is carried out by extending a plurality of laterally spaced scarifying elements into the heated pavement.

17. In a method as set forth in claim 13 wherein said heating of the elevated mixture is carried out during the passage of the elevated mixture in contact with heated, heat-conductive members extending along a course of travel for the mixture.

18. In a method as set forth in claim 17 wherein said heating of the elevated mixture raises said elevated mixture to a temperature of between about 280° F. and 320° F.

19. In a method as set forth in claim 13 wherein said conditioner is in the form of a liquid additive having a viscosity and a solubility in a range capable of softening the old pavement to reduce the viscosity of the mixture to the range of virgin asphalt.

20. In a method as set forth in claim 13 wherein said conditioner substantially replaces the resins lost during oxidation that takes place in old asphaltic pavement.

21. In a method as set forth in claim 13 wherein said converted aggregate-asphalt mixture has a consistency of approximately the original aggregate size range.

22. In a method as set forth in claim 13 further including the steps of spreading and leveling the reconditioned mixture over a ground surface and compacting the leveled mixture into a new mat of asphaltic pavement while moving relative to the ground surface and coordinated in movement with said converting, heating and mixing.

23. In a method as set forth in claim 22 including the step of adding a tacking coat to a mixture of materials remaining on the ground surface prior to spreading and leveling the reconditioned mixture over the ground surface for causing improved adherence of the mixture with the ground surface.

24. In a method as set forth in claim 13 wherein said steps of converting, heating and mixing are carried out in a sequency by vehicular apparatus that is moved at a steady, coordinated rate of travel.

25. In a method as set forth in claim 13 wherein there are two successive stages of heating and scarifying to achieve substantial depth and old asphaltic pavement removal.

26. In a method as set forth in claim 13 wherein the mixture is graded into a pile that is then elevated from the ground surface for subsequent heating.

27. In a method of treating asphaltic pavement for road surfacing and the like, the steps comprising:

converting old asphaltic pavement on a ground surface into a loose, heated, aggregate-asphalt mixture by heating said pavement to a selected temperature and depth and reducing the size thereof to approximately the original aggregate size range while said pavement and mixture remains on the ground surface and while moving relative to the ground surface;

picking up said mixture from the ground surface while moving relative to the ground surface;

adding a preselected amount of conditioner for old asphaltic pavement to said picked-up mixture, said conditioner replacing at least some of the ingredients lost during oxidation of the old asphaltic pavement and softening said pavement; and thoroughly and imtimately mixing the conditioner and picked-up mixture independently of the ground surface while confined in a mixing chamber supported above the ground surface, said chamber having a bottom wall over which the conditioned mixture is moved above the ground surface between an inlet and an outlet and further having paddle blades disposed in an axially spaced and radially extending arrangement above the bottom wall between the inlet and outlet, to form a reconditioned mixture of a composition and consistency suitable for being rolled into a new mat of asphaltic pavement while moving relative to the ground surface, said converting, picking up and mixing being coordinated in movement with one another relative to the ground surface.

28. In apparatus for reconditioning asphaltic pavement for road surfacing and the like, a combination comprising:

a frame supported on wheels for vehicular movement over a ground surface;

an elongated, generally cylindrical housing on said frame mounted for rotation about a longitudinal axis forming an inner chamber elevated above the ground surface having a material inlet at one end and a material outlet at the opposite end through which a loose asphalt-aggregate mixture delivered to said material inlet passes and is discharged through said material outlet, said chamber having a gas inlet at one end and a gas outlet opposite the gas inlet to pass gas through said chamber;

drive means operatively associated with said housing for rotating said housing about its longitudinal axis;

heating means operatively associated with said housing for heating gases passed through said gas inlet in heat exchange relation to said mixture and out said gas outlet to heat said mixture as said mixture is tumbled in said housing for uniformly, simultaneously heating and mixing said mixture;

means movable with said heating means and operatively associated with said housing for adding a conditioner replacing at least some of the ingredients lost by oxidation of the asphaltic pavement to said heated mixture; and mixing apparatus on said frame for uniformly mixing said heated, conditioned mixture, said housing having a plurality of circumferentially spaced inlet openings on the periphery thereof adjacent the front end, each having a scoop arranged to direct said mixture into the inside of the housing upon the rotation thereof from a feed trough.

29. In apparatus as set forth in claim 28 wherein said housing has a plurality of circumferentially spaced outlet openings in the periphery adjacent the rear end and a shroud enclosing the openings with a chute for directing the discharging heated mixture into the inlet of said mixing apparatus.

* * * * *